US006006688A

United States Patent [19]

Hansen et al.

[11] Patent Number: 6,006,688

[45] Date of Patent: Dec. 28, 1999

[54] TRIMMING DEVICE ON THE MAST TOP OF A WINDSURFING RIG

[75] Inventors: Reinhard Hansen, Salzburg, Austria; Neil Pryde, Tai Po, The Hong Kong Special Administrative Region of the People's Republic of China

[73] Assignee: Goodwell International, Ltd., Virgin Islands (Br.)

[21] Appl. No.: 08/992,152

[22] Filed: Dec. 17, 1997

[30] Foreign Application Priority Data

Sep. 1, 1997 [DE] Germany ..... 197 38 116

[51] Int. Cl.[6] ..... B63H 9/08

[52] U.S. Cl. ..... 114/102.12; 114/108

[58] Field of Search ..... 114/94, 90, 102, 114/108, 109, 39.2, 39.12, 102.12

[56] References Cited

U.S. PATENT DOCUMENTS

| | | | |
|---|---|---|---|
| 4,365,570 | 12/1982 | Jamieson | 114/102 |
| 4,977,843 | 12/1990 | Ewert et al. | 114/109 |
| 5,239,939 | 8/1993 | Purdy | 114/109 |
| 5,372,080 | 12/1994 | Sewell | 114/39.2 |

FOREIGN PATENT DOCUMENTS

| | | | |
|---|---|---|---|
| 386 170 B | 7/1988 | Austria | B63B 15/00 |
| 257140 | 3/1988 | European Pat. Off. | 114/109 |
| 3241165 A1 | 5/1984 | Germany | B63B 15/00 |
| 3319823 A1 | 12/1984 | Germany | B63H 9/08 |
| 3526464 A1 | 2/1986 | Germany | B63H 9/10 |
| 3436718 | 4/1986 | Germany | 114/39.2 |
| 3608401 A1 | 9/1987 | Germany | B63H 9/10 |
| 3633752 A1 | 4/1988 | Germany | B63B 15/00 |
| 3928761 C2 | 3/1991 | Germany | B63H 9/10 |
| 59-220490 | 12/1984 | Japan | B63H 9/10 |
| 8188 | 1/1985 | Japan | 114/108 |
| 2234729 | 2/1991 | United Kingdom | B63H 9/10 |

OTHER PUBLICATIONS

Surf Magazine, Aug. 1988, pp. 40–42.

*Primary Examiner*—Sherman Basinger
*Attorney, Agent, or Firm*—Senniger, Powers, Leavitt & Roedel

[57] ABSTRACT

A trimming gear on the mast top of a windsurfing rig having an adjusting element that can be connected to the sail top and fixed relative to the mast is arranged on the mast top. The adjusting element is actuated by a reducing gear and can be displaced in the longitudinal direction of the mast. Since the adjusting element is actuated by a reducing gear, it is possible to precisely adjust or trim the sail top with a relatively low expenditure of force, namely also in the tensioned state.

21 Claims, 7 Drawing Sheets

TRIMMING DEVICE ON THE MAST TOP OF A WINDSURFING RIG

BACKGROUND OF THE INVENTION

The invention pertains to the trimming gear on the mast top of a windsurfing rig.

Such trimming gear has been available on the market for quite some time. The free end of a surf board mast is referred to as the "mast top," and the part of the sail which is fastened to the mast top is referred to as the "sail top." It is known to fasten sail tops to mast tops by means of belt bands that are connected to the sail. For this purpose, a cap with a groove on its upper side is provided on the mast top. In order to tension the sail, the belt is placed into the groove such that it overlaps the cap. The belt is provided with a buckle within the area situated between the cap and a fastening point on the sail such that the length of the belt can be adjusted, i.e., the height of the sail top can be adjusted by a few centimeters. Such an adjustment is referred to as "top trim."

However, this buckle merely makes it possible to position a nontensioned sail relative to the mast. A tensioned sail can only be trimmed to a very limited degree because the friction between the belt and the buckle only allows the transmission of relatively low tensioning forces onto the sail. Consequently, the sail is usually tensioned by means of a bolt rope tensioning device arranged on the foot of the mast. In addition, the belt is merely fixed in the buckle by friction, i.e., the belt may slip such that the sail trim is unintentionally altered.

SUMMARY OF THE INVENTION

The present invention is based on the objective of improving the trimming gear of the type described above in such a way that the sail can be precisely trimmed in the tensioned state and the adjusted trim remains constant.

This invention is directed to trimming gear adapted for attachment to a mast top of a windsurfing rig having a mast and a windsurfing sail. The trimming gear comprises an adjusting element having a length of which can be varied in order to adjust a bolt rope tension of the windsurfing sail. The adjusting element comprises a first part adapted for displacement along a longitudinal axis of the mast, locking elements for fixing the first part relative to the mast, a reducing gear for increasing force applied to the mast, which gear acts upon the first part along said longitudinal axis, and a connector for connecting the first part to the sail.

The basic principle of the invention consists of arranging an adjusting element that can be displaced in the longitudinal direction of the mast and connected to the sail top on the mast top, wherein the position of the adjusting element relative to the mast can be adjusted by means of a reducing gear and fixed relative to the mast. Since the adjusting element is actuated via a reducing gear, it is possible to precisely adjust or trim the sail with a relatively low expenditure of force, namely even if the sail is tensioned. It is particularly advantageous that a controlled trim or adjustment can be realized in both directions, i.e., the belt band can be tensioned and loosened. It is preferred to realize the precise trimming in a variable fashion. However, it is also possible to realize the adjustment in a graduated fashion. The adjusted sail trim can be maintained constant by locking the adjusting element. This lock is effective in the tensioning direction and the loosening direction. However, it suffices if the lock only acts in the loosening direction, i.e., opposite to the tensioning force, because an unintentional additional tensioning of the sail during surfing does not occur.

According to one additional development of the invention, the adjusting element is arranged on the mast top in a telescope-like fashion and connected to the mast either directly or via a coupling element. Consequently, longitudinal movement is possible, and tensioning forces that are applied onto the adjusting element and act in the transverse direction can be introduced into the mast.

According to one additional development of the invention, the adjusting element is connected to the mast by means of a thread arranged in the longitudinal direction of the mast. The screw connection is self-locking, i.e., even high tensioning forces applied onto the adjusting element do not cause an unintentional alteration of the sail trim.

According to one additional development of the invention, the reducing gear is realized in the form of a block and pulley, wherein first pulleys of the block and pulley are connected to the mast and second pulleys are connected to the adjusting element.

In addition it is possible to realize a relative movement between the adjusting element and the mast by means of a toothed wheel that meshes with teeth arranged in the longitudinal direction of the mast. Alternatively, this relative movement may also be realized by means of a toothed rack or a toothed belt that cooperates with a ratchet lever. Another option consists of generating the adjusting forces in the longitudinal direction of the mast by means of a hydraulic device arranged on the adjusting element or on the mast. In addition, it is possible to generate tensioning forces between the adjusting element and the mast with a series of other power transmission mechanisms, e.g., a cable winch with a cable control, a cam mechanism or the like.

BRIEF DESCRIPTION OF THE DRAWINGS

The invention is described in detail below with reference to several embodiments that are illustrated in the figures. The figures show.

DETAILED DESCRIPTION OF THE INVENTION

Figure 1B:
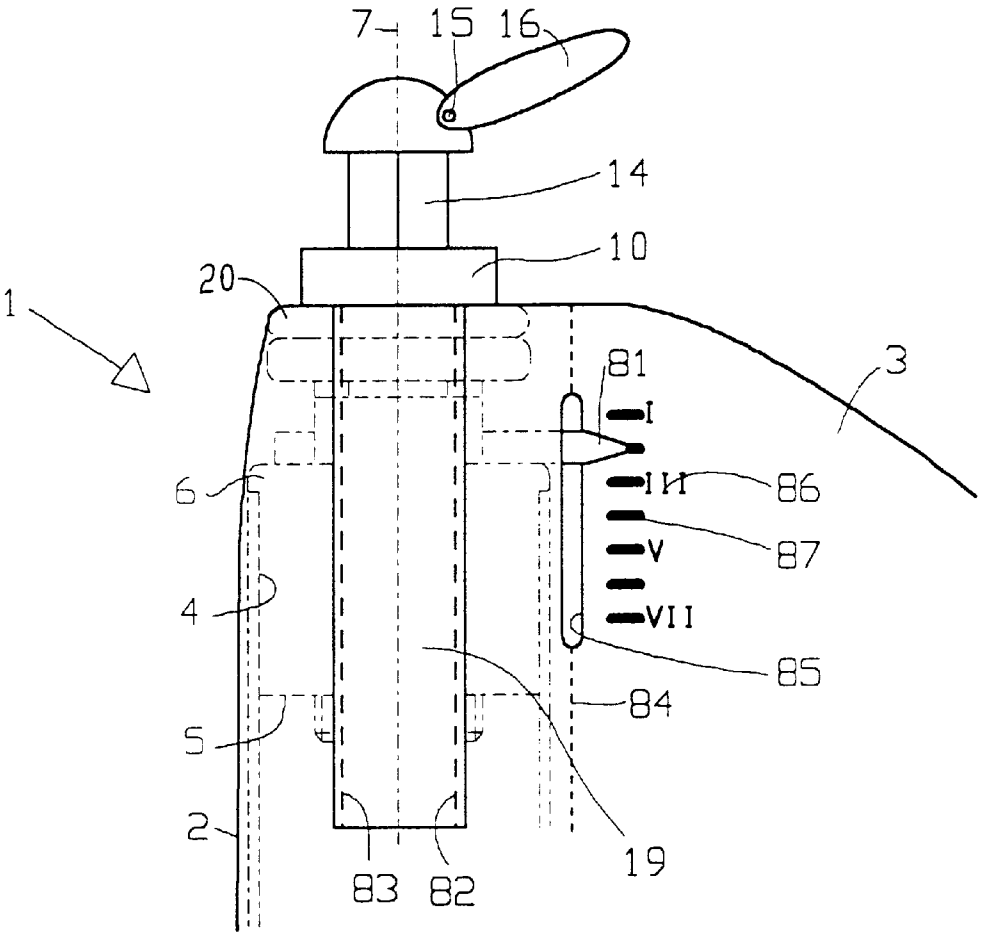
FIG. 1*b*, the embodiment according to FIG. 1*a* in the rigged state.
Figure 1A:
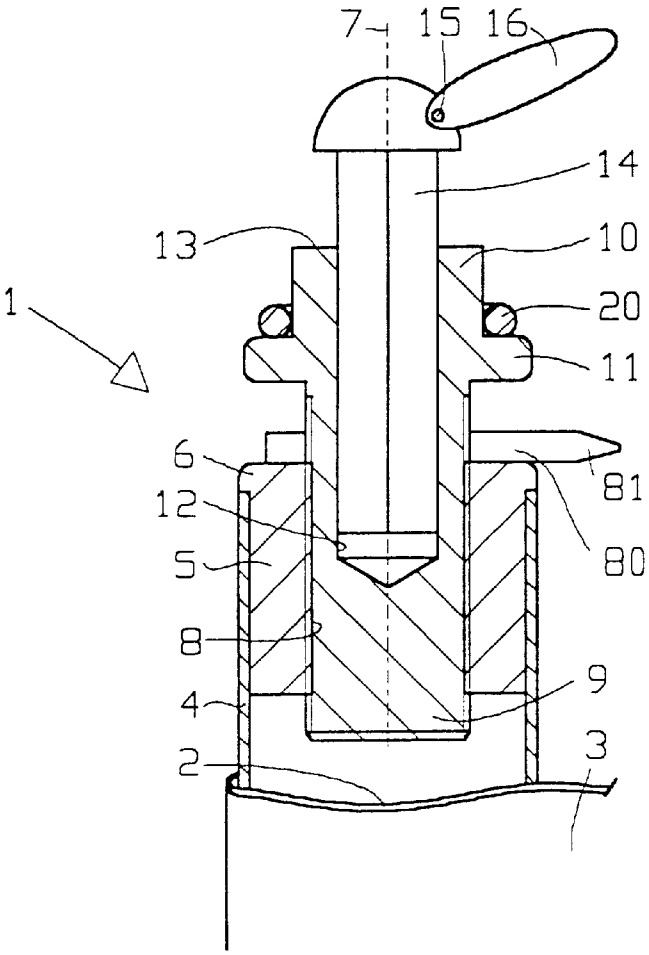
FIG. 1*a*, a sectional representation of a first embodiment of an adjusting element that is partially arranged in a mast, wherein the sail top is illustrated in the form of a sectional representation.

FIGS. 1*a* and 1*b* show part of a windsurfing rig within the region of the mast top 1. A mast 4 is inserted into the mast pocket 2 of a sail 3, wherein the sail top and the mast top 1 are illustrated in FIGS. 1*a* and 1*b* in the form of a sectional representation in order to better explain the invention.

The part 5 of an adjusting element which serves as a closing element as well as a threaded bushing is inserted into the mast 4. The end of this part is provided with a holding tab 6 that adjoins the mast 4. A positioning arm 80, the free end 81 of which protrudes from the mast 4 similar to a dial, is fastened to the holding tab 6. The positioning arm 80 is, for example, bonded or screwed to the part 5 of the adjusting element. The part 5 is provided with a continuously threaded bore 8 that is arranged centrally, i.e., parallel to the longitudinal axis 7 of the mast.

A bolt-like tensioner 9 of the adjusting element is screwed into the threaded bore 8. In the embodiment shown in FIGS. 1*a* and 1*b*, this bolt-like part is sufficiently long to extend through the part 5 and protrude from the free end of the mast 4. On its end that is situated opposite to the threaded bore 8, the tensioner 9 is provided with a holding extension 10, on which a radially widened, annular shoulder 11 is arranged. In addition, the tensioner 9 is provided with a polygonal recess 12 that extends parallel to the longitudinal direction 7 of the mast and is open toward its upper side 13. A hexagonal part 14 is inserted into the polygonal recess 12. On its end situated opposite to the recess 12, this hexagonal part 14 is provided with a lever 16 that can be pivoted about an axis 15, transverse to the longitudinal direction 7 of the mast.

A ring 20 that rests on the shoulder 11 and is connected to the sail 3 is placed over the holding extension 10 of the tensioner 9 of the adjusting element (FIG. 1*b*).

FIG. 1*b* shows that the ring 20 is also connected to one end of a belt band 19 that is sewn to the sail 3 by means of seams 82 and 83. Consequently, the ring 20 serves as a reinforcing ring and prevents the sail 3 placed over the tensioner 9 from tearing. In the embodiment shown, only one belt band 19 is visible. One additional belt band that is analogously connected to the ring 20 and the sail 3 lies behind the plane of projection and is not visible in the figure.

This figure also shows that the sail 3 comprises a seam 84 that extends parallel to the longitudinal direction 7 of the mast and forms the border of the mast pocket 2. Within the region of this seam 84, the mast pocket 2 is provided with a slot 85 that extends in the longitudinal direction 7 of the mast. This slot is at least as long as the maximum adjusting length of the tensioner 9, wherein the free end 81 of the positioning arm 80 protrudes through this slot. Line markings 87 provided with numbers, letters or other symbols 86 are arranged, e.g., printed, on the sail 3 along the slot 85. The trim of the sail 3 can be ascertained by the position of the line markings 87 relative to the positioning arm 80, wherein the sail is highly tensioned if the arm 80 points to the number VII.

The tensioner 9 can be moved in the longitudinal direction 7 of the mast, i.e., screwed up or down, relative to the tensioner 5 or the mast 4 by turning said part about the longitudinal axis 7. If the tensioner 9 of the adjusting element is turned in such a way that the annular shoulder 11 moves away from the mast 4, the ring 20 is moved in the longitudinal direction 7 of the mast and the sail 3 connected to said ring is tensioned. A power reduction can be attained with the aid of the hexagonal part 14 or the lever 16 arranged thereon, i.e., it is possible to transmit high tensioning forces onto the sail 3 with a lower expenditure of force. After the sail 3 has been trimmed in the desired fashion, the hexagonal part 14 may be retracted from the recess 12 of the tensioner 9 such that the weight of the mast top 1 is reduced. Due to the self-locking effect of the thread 8, the tensioner 9 cannot be "pressed" into the mast 4, namely even if high tensioning forces are applied. Consequently, the adjusted sail trim is not altered.

Alternatively to the embodiment shown, an internal thread may be provided in the mast 4 such that the tensioner 9 can be directly screwed into the mast 4. In addition, it is possible to design the mast pocket 2 transparently within the region of the positioning arm 80, with the mast pocket being so wide that the positioning arm can be accommodated in the mast pocket 2 and the trim value can be externally "read."

Figure 2:
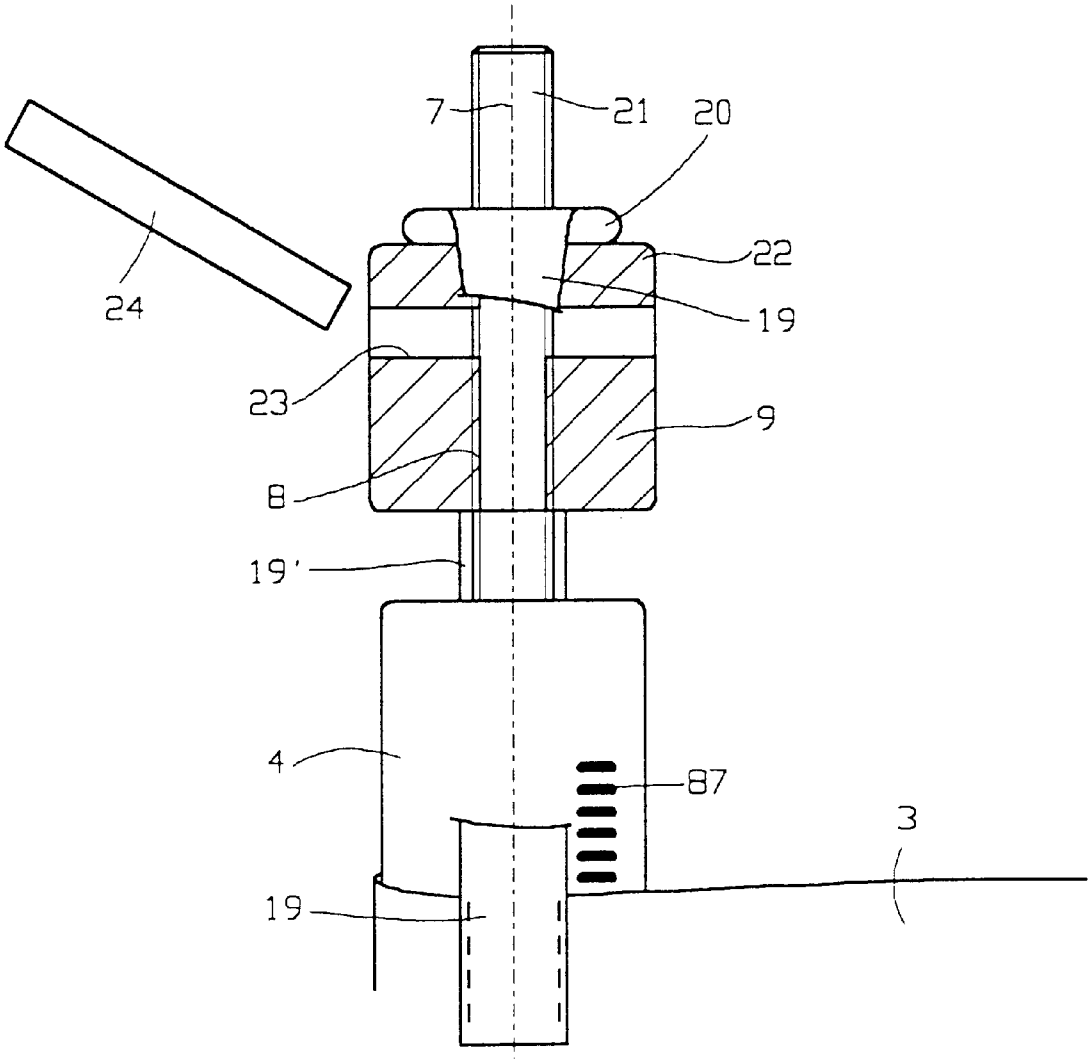
FIG. 2, an adjusting element with a threaded rod that is rigidly connected to and protrudes from the mast.

FIG. 2 shows an embodiment in which a threaded rod 21 that is connected to the mast 4, in a rotationally rigid fashion, protrudes from the mast. This threaded rod also forms part of the adjusting element and extends in the longitudinal direction 7. The adjusting element 9 is screwed onto the threaded rod 21. In the embodiment shown, the adjusting element consists of a cylindrical body with a central threaded bore 8. Since the threaded rod 21 connects the tensioner 9 of the adjusting element to the mast 4, its function corresponds to that of the part 5 in FIG. 1*a*. The ring 20 that is connected to one end of the belt band 19 rests on one end 22 of the screwed-on part 9. The other end of the belt band 19 is connected to the sail 3, the upper portion or "top" of which is situated at a distance from the adjusting element 9 in this case. One additional belt band 19' is partially covered by the tensioner 9 and the threaded rod 21. This additional belt band is connected to the ring 20 and the sail 3 analogous to the belt band 19.

The tensioner 9 is also provided with a through-hole 23 that extends perpendicular to the longitudinal direction 7 of the mast. A lever 24 can be inserted into the through-hole 23 in order to turn the adjusting element 9, i.e., to tension the sail 3 connected thereto.

The momentary trim of the sail 3 can be ascertained by the line markings 87 arranged on the mast 4. Depending on the respective trim, only a certain number of line markings 87 are visible, with the remainder of said line markings being covered by the sail. Alternatively, it is also possible to arrange a reference marking or a marking element, e.g., a pin that points toward the mast end, on the adjusting element 9 such that the position of the sail 3 relative to the markings can be read on the mast 4.

In the embodiment shown, the diameter of the tensioner 9 of the adjusting element approximately corresponds to that of the mast 4, wherein the lever 24 serves for realizing the adjustment, i.e., for trimming the sail 3. The expenditure of force required for the adjustment can also be easily reduced without a lever by increasing the diameter of the tensioner 9 or by providing a corresponding widening in the form of a handwheel.

Alternatively to the embodiment shown, an external thread, onto which the tensioner 9 is screwed, may be arranged on the mast 4.

FIG. 3 a shows an embodiment in which the adjustment of the tensioner 9 is realized by means of a block and pulley 25. This embodiment is illustrated in such a way that only the mast pocket 2 of the sail 3 is visible and the remainder of the sail is covered by the mast 4. First pulleys 26 of the block and pulley 25 are rotatably arranged on an axis 27 that is connected to the mast 4. Second pulleys 28 of the block and pulley 25 are arranged on an axis 29 that is rigidly connected to the tensioner 9 of the adjusting element which is arranged in the mast 4 in a telescope-like fashion. Within the region of the block and pulley 25, the mast 4 is provided with a corresponding recess 30 so as to allow the unobstructed adjustment of the block and pulley 25. The first and second pulleys 26 and 28 are connected to one another via a rope 31, the first end 32 of which is fastened to the mast 4. The other end 33 of the rope 31 can be locked in a holding element 34 fastened to the mast 4, e.g., a clamp.

The second pulleys 28 move in the direction of the first pulleys 26 by pulling on the end 33, i.e., the tensioner 9 can be pushed out of the mast 4 with a relatively low expenditure of force and the sail 3 can be trimmed. On its free end, the tensioner 9 is provided with a guide extension 35 with a groove 36. A belt band 19 that overlaps the tensioner 9 is inserted into the groove 36. Both ends 37 and 38 of the belt band 19 are directly connected to the mast pocket 2 of the sail 3.

Alternatively, the belt 19 may be fastened to the tensioner 9 analogous to FIG. 1*a* by means of a ring 20.

Figure 3B:
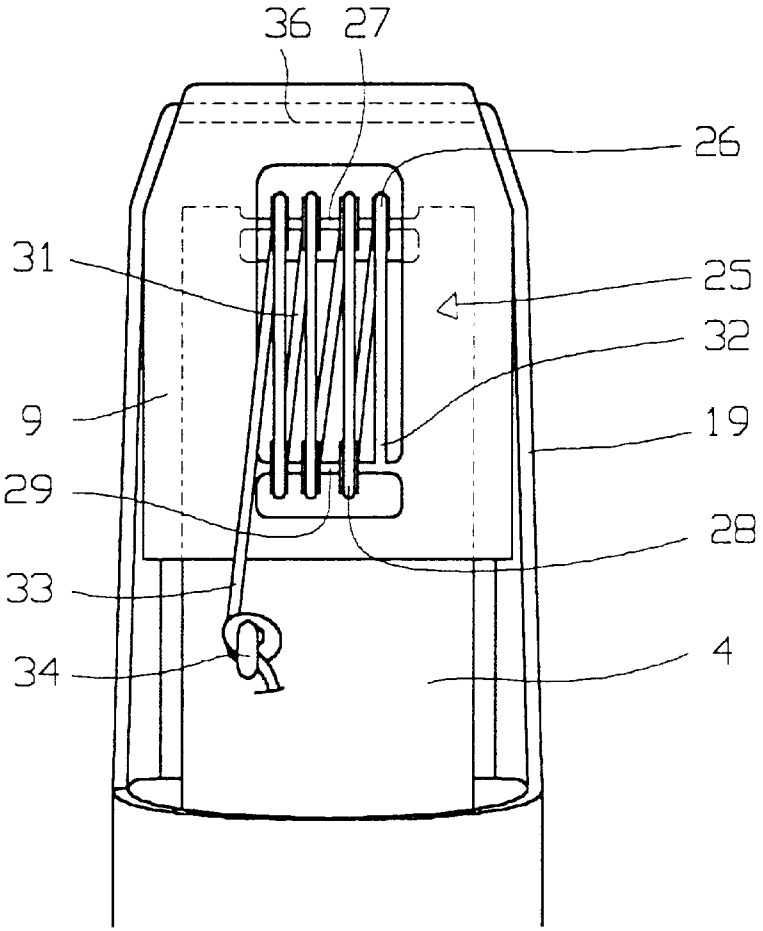
FIGS. 3*a* and 3*b*, embodiments with a block and pulley.
Figure 3A:
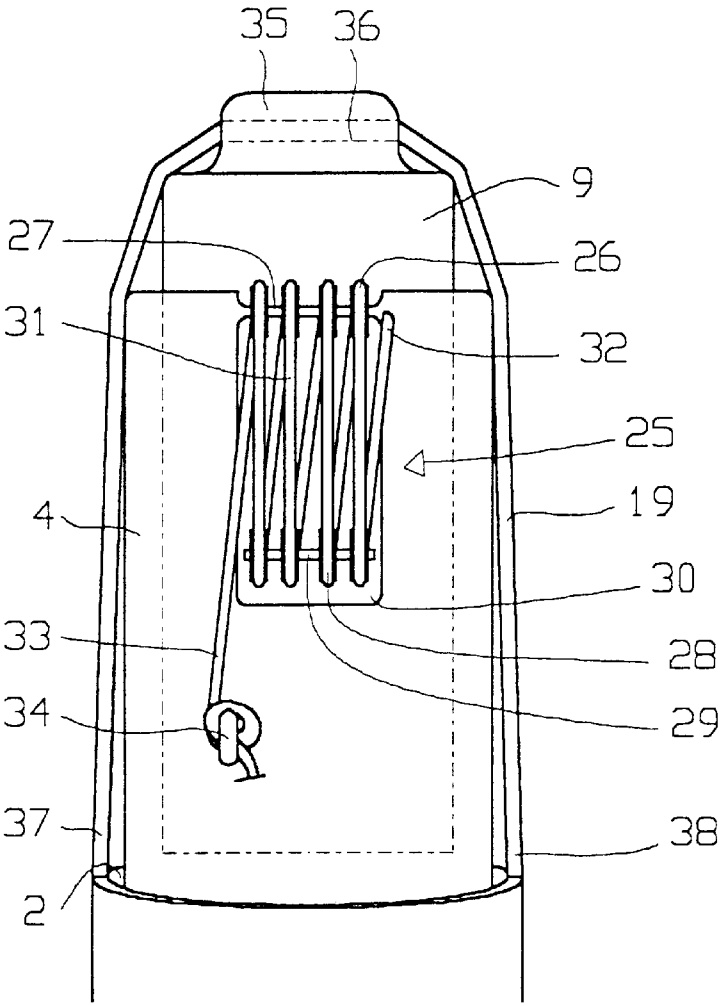

In contrast to FIG. 3*a* in which the tensioner 9 is inserted into the mast 4, the mast 4 is inserted into the tensioner 9 in the embodiment according to FIG. 3*b*. In this case, first pulleys 26 of the block and pulley 25 are rotatably arranged on an axis 27 of the mast 4. Second pulleys 28 as well as the end 32 of the rope 31 are arranged on an axis 29 that forms part of the tensioner 9. The second pulleys 28 move in the direction of the first pulleys 26 by pulling on the end 33 such that the tensioner 9 is moved away from the sail and the tension of the belt band 19 as well as the bolt rope tension of the sail 3 are increased.

Very high tensioning forces can be transmitted with both "telescopic variations" shown in FIGS. 3*a* and 3*b*. A sufficient guidance of the tensioner 9 by the mast 4 is ensured in both variations. The adjusted position of the tensioner 9 can be fixed by locking the end 33 in the holding element 34.

Figure 4B:
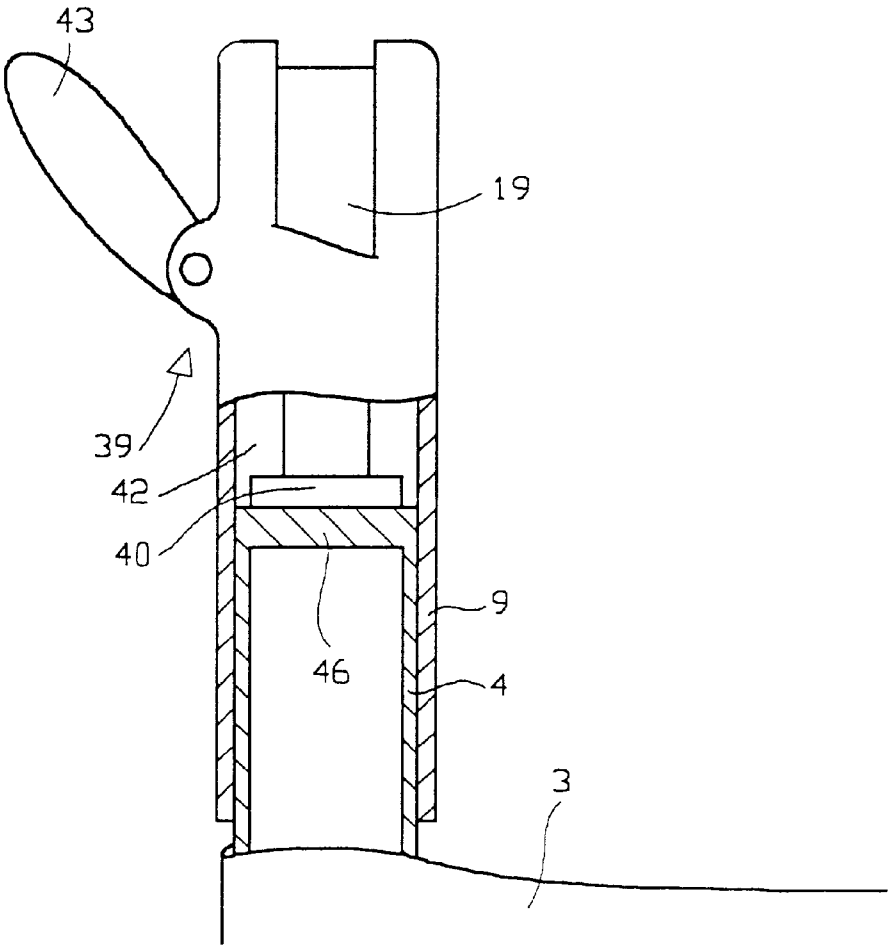
FIGS. 4*a* and 4*b*, embodiments with a hydraulic actuating device.
Figure 4A:
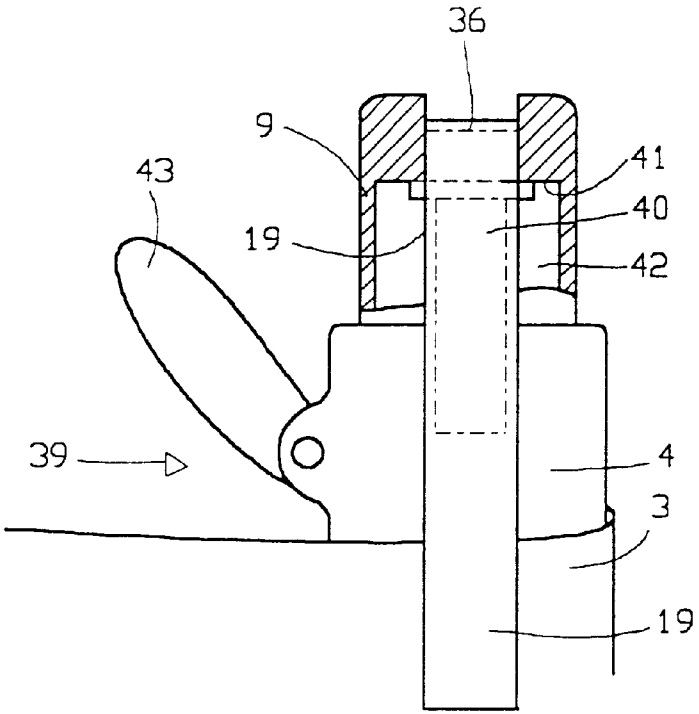

FIGS. 4*a* and 4*b* show embodiments in which the adjustment of the tensioner 9 is realized by means of a hydraulic pump 39.

In the embodiment according to FIG. 4*a*, the hydraulic pump 39 is integrated into the mast 4. A pressure piston 40 of the hydraulic pump 39 presses against the inner surface 41 of a recess 42 of the tensioner 9. Consequently, the tensioner 9 can be pressed out of the mast 4 by actuating the actuating lever 43 of the hydraulic pump 39 such that the sail 3 is trimmed via the belt band 19 connected thereto. The belt band 19 is secured from being laterally displaced by the groove 36. Both ends of the belt band (only one end is visible because the other end is covered by the mast 4) are connected to the sail 3. The tensioner 9 may be fixed by means of a valve (not shown) of the hydraulic pump.

In the embodiment shown in FIG. 4*b*, the hydraulic pump 39 is integrated into the tensioner 9. In addition, the mast 4 protrudes into the recess 42 of the tensioner 9 and is limited by the end wall 46 on its free end. Once the actuating lever 43 is actuated, a pressure piston 40 of the hydraulic pump 39 presses against the end wall 46. Consequently, a relative movement between the tensioner 9 and the mast 4 takes place such that the belt band 19 or the sail 3 connected thereto is tensioned.

Figure 5:
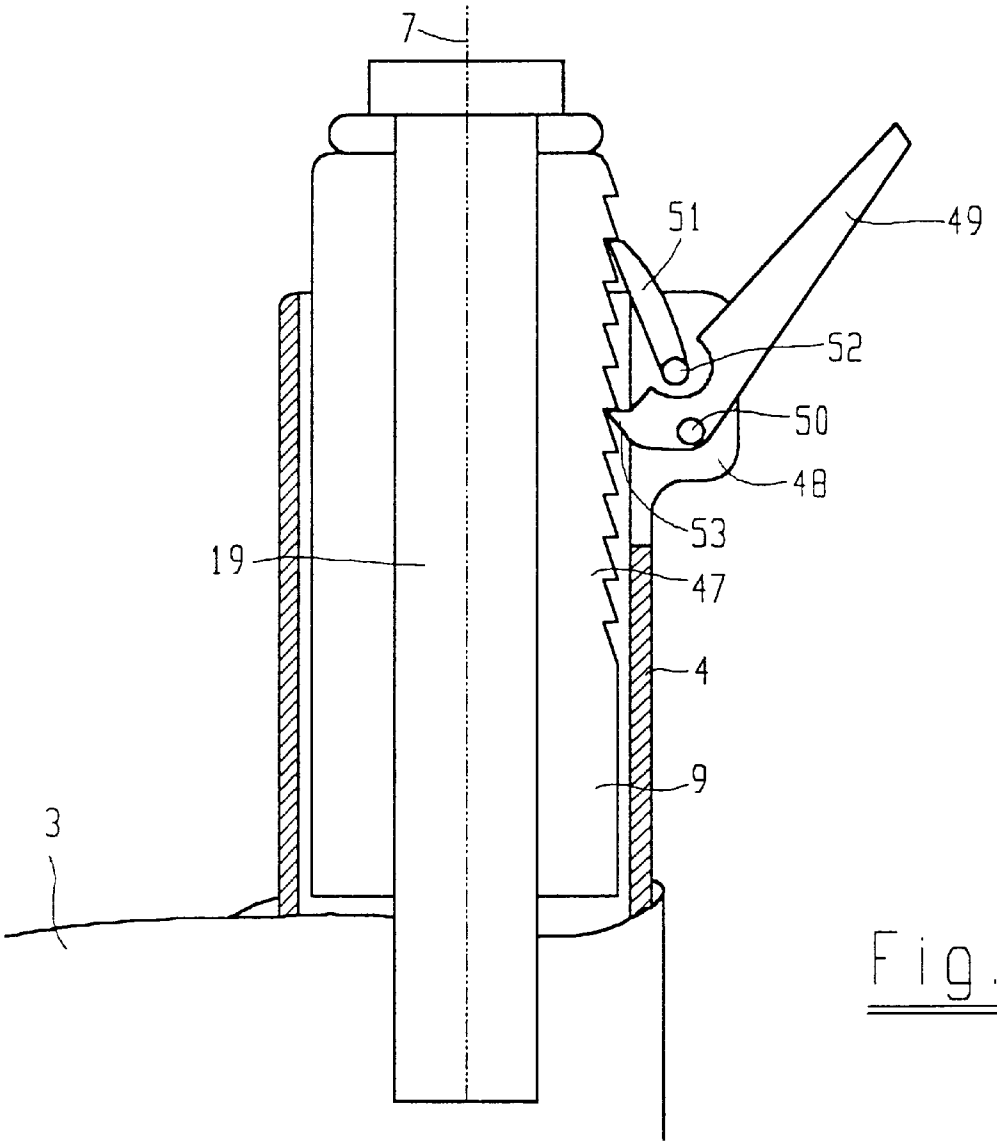
FIG. 5, an embodiment with a ratchet lever and an external toothing on the adjusting element.

FIG. 5 shows a tensioner 9 that is inserted into the mast 4 and provided with an external toothing 47 in the longitudinal direction 7 of the mast on its outer side. A locking lever 49 is arranged in a recess of a lateral thickening 48 of the mast 4 such that it can be pivoted about an axis 50. In addition, a detent pawl 51 is arranged in the thickening 48. This detent pawl can be pivoted about a swiveling axis 52 and is pressed against the external toothing 47 by means of a spring that is not shown.

In the position shown, the locking lever 49 as well as the detent pawl 51 engage into the external toothing 47 of the tensioner 9 such that said part is locked in the position shown, namely even if the sail 3 is tensioned. If the locking lever 49 is pivoted about the swiveling axis 50, a shoulder 53 of the locking lever 49 which is engaged with the external toothing 47 slightly presses the tensioner 9 out of the mast 4 such that the sail 3 can be trimmed via the belt band 19.

Figure 6B:
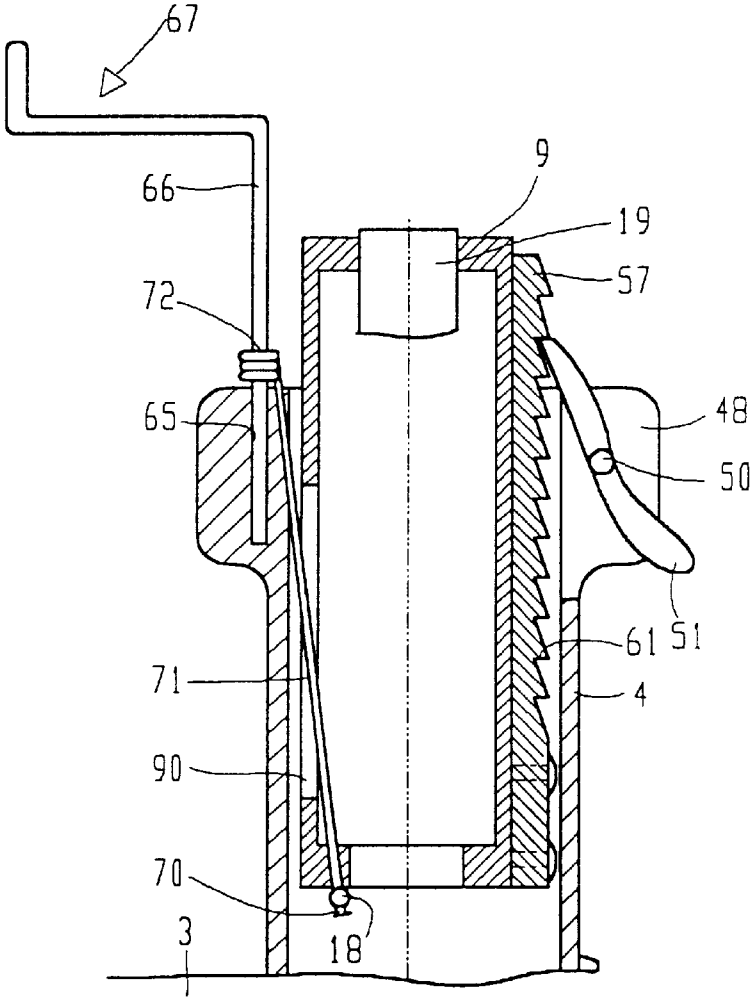
FIG. 6*b*, an embodiment similar to that shown in FIG. 6*a*.
Figure 6A:
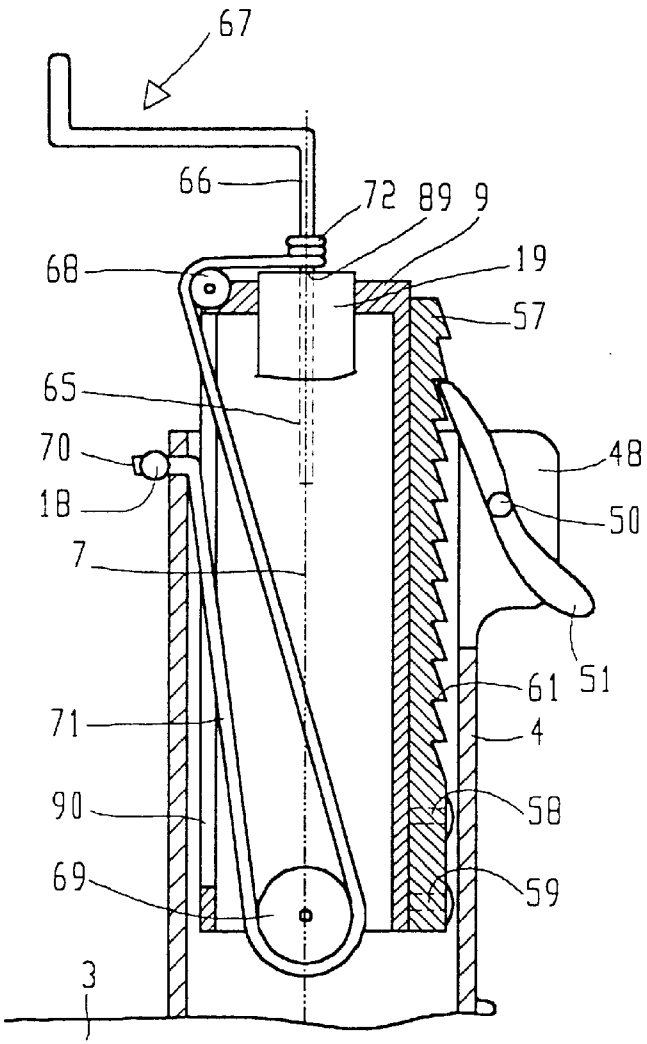
FIG. 6*a*, an embodiment similar to that shown in FIG. 5 with a toothed belt fastened to the adjusting element and an actuating crank.

FIG. 6*a* shows a tensioner 9 that is inserted into the mast 4. A toothed belt 57 is fastened to the outside of the tensioner 9 in the longitudinal direction of the mast by means of rivets 58 and 59. The belt band 19 connected to the sail 3 is placed over the end of the tensioner 9 which protrudes out of the mast 4. This belt band is provided with a hole 89 that is aligned with a bore 65 of the tensioner 9 which is arranged centrally, i.e., in the longitudinal direction 7 of the mast. The part 66 of a crank 67 which protrudes into the bore 65 extends through the hole 89 in the belt band 19. The aforementioned part of the crank acts as a winding spindle. In addition, a longitudinal slot 90 is arranged in the side wall of the tensioner 9.

A first pulley 68 is rotatably arranged on the end of the tensioner 9 which protrudes out of the mast 4, with a second pulley 69 being rotatably arranged on the end of this part which is inserted into the mast 4. The first end 70 of a rope 71 is fastened to the free end of the mast 4 with an end section 18. The rope 71 extends inward through the wall of the mast 4 and through the longitudinal slot 90 and is looped around both pulleys 68 and 69. The other end 72 of the rope 71 is fastened to the crank 67.

The rope 71 is wound onto the winding spindle 66 of the crank 67 such that the tensioner 9 is pulled out of the mast 4 by turning the crank 67 about the longitudinal axis 7 of the mast. A power reduction similar to that of a block and pulley is attained by the pulley 69. This power reduction can be arbitrarily increased depending on the length of the crank 67, i.e., the sail 3 can be trimmed with a low expenditure of force via the belt band 19 connected to the sail.

The locking lever 51 that is arranged in the thickening 48 such that it can be pivoted about the swiveling axis 50 is engaged with the teeth 61 of the toothed belt 57. This locking lever blocks the tensioner 9 from being displaced in one direction when the sail 3 is tensioned, i.e., it prevents the tensioner 9 from sliding into the mast 4.

In the embodiment according to FIG. 6*b*, the crank 67 is inserted into a recess 65 of the mast 4. One end 72 of the rope 71 is fastened to the crank 67, and the other end 70 is directly fastened to the end of the tensioner 9 which is inserted into the mast 4 with the end section 18. In this case, the rope 71 extends through the longitudinal slot 90. If the crank 67 is turned, the tensioner 9 is pulled out of the mast such that the sail 3 is tensioned, with the aforementioned part being locked in its position by the locking lever 51. In this case, the attainable power reduction exclusively depends on the length of the crank used.

Figure 7:
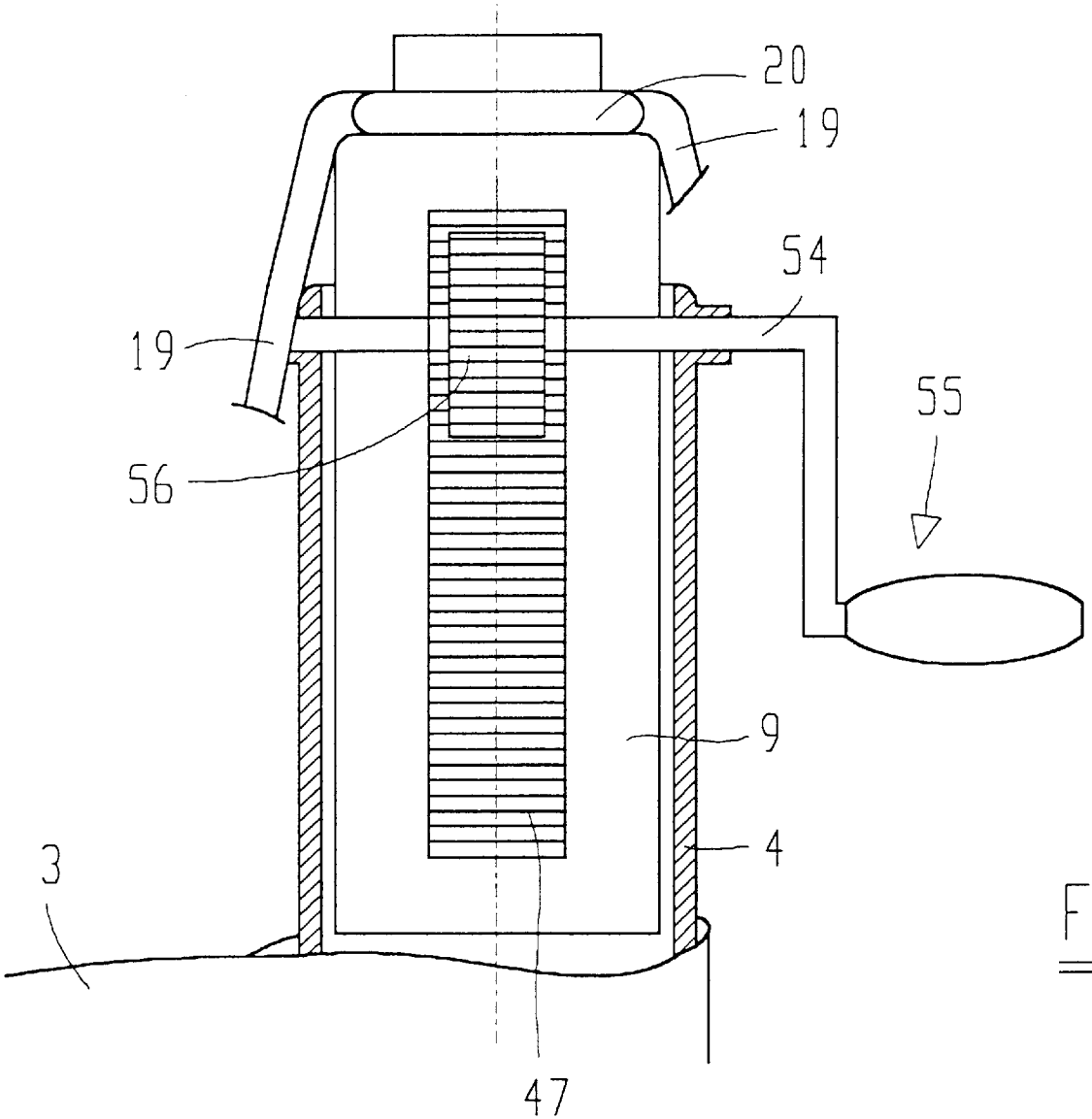
FIG. 7, an embodiment with a toothed wheel and a toothed rack.

FIG. 7 shows a tensioner 9 that is inserted into a mast 4. The outside of this part is provided with an external toothing 47 similar to a toothed rack in the longitudinal direction 7 of the mast. The rotational axis 54 of a crank 55 is arranged in the mast 4. A toothed wheel 56 that meshes with the external toothing 47 is arranged on the rotational axis 54 within the region of the external toothing 47. The external toothing 47 of the tensioner 9 is displaced by turning the crank 55, i.e., the sail 3 can be trimmed via the belt band 19. The adjusted sail trim can be maintained constant by "blocking" the toothed wheel 56 or the crank 55, e.g., by means of blocking pins (not shown) that are laterally inserted into the mast 4.

Alternatively, it is possible to utilize an actuating worm that cooperates with a toothed rack. Such a worm drive provides the advantage that it is self-locking, i.e., an adjustment is only possible by actuating the worm.

As various changes could be made in the above embodiments without departing from the scope of the invention, it is intended that all matter contained in the above description shall be interpreted as illustrative and not in a limiting sense.

What is claimed is:

1. Trimming device adapted for attachment to a mast of a windsurfing rig having a windsurfing sail, the trimming device comprising:

an adjusting element which can be displaced in order to adjust a bolt rope tension of the windsurfing sail, the adjusting element including a tensioner adapted for displacement in alignment with a longitudinal axis of the mast, locking elements for fixing the tensioner relative to the mast, a reducing element for increasing force applied to the trimming device, the reducing element acting upon the tensioner along said longitudinal axis, and a connector for connecting the tensioner to the sail, the trimming device being attached to the mast top of the windsurfing rig.

2. The trimming device according to claim 1 wherein the tensioner can be displaced relative to the mast in a telescoping fashion.

3. The trimming device according to claim 1 wherein the tensioner is at least partially surrounded by the mast in a sleeve-like fashion.

4. The trimming device according to claim 1 wherein the tensioner is surrounded by a closing element part of the adjusting element which is connected to the mast.

5. The trimming device according to claim 1 wherein part of the mast is surrounded by the tensioner in a sleeve-like fashion.

6. The trimming device according to claim 1 wherein a closing element connected to the mast is surrounded by the tensioner in a sleeve-like fashion.

7. The trimming device according to claim 6 wherein the closing element consists of a threaded rod that is connected to the mast in a rotationally rigid fashion and protrudes from the free end of the mast, and wherein the tensioner is screwed onto the threaded rod.

8. The trimming device according to claim 1 the tensioner having a threaded section engaging the mast for displacement of the tensioner relative to the mast.

9. The trimming device according to claim 1 wherein a closing element has a threaded bushing that is inserted into the mast in rotationally rigid fashion, and wherein the tensioner is screwed into the bushing along the longitudinal axis.

10. The trimming device according to claim 1 wherein first pulleys of a block and pulley are arranged on the free end of the mast, wherein second pulleys of the block and pulley are arranged on the tensioner, and wherein the tensioner can be displaced relative to the mast by means of said block and pulley.

11. The trimming device according to claim 1 wherein one part of a crank which acts as a winding spindle is rotatably inserted into a recess in an end of the tensioner which protrudes from the mast, wherein a first end of a rope can be wound onto said winding spindle, wherein the rope is partially looped around a pulley arranged on the tensioner, and wherein another end of the rope is rigidly connected to the mast.

12. The trimming device according to claim 1 wherein one part of a crank which acts as a winding spindle is rotatably inserted into a recess in a wall of the mast, wherein a first end of a rope can be wound onto said winding spindle, and wherein another end of the rope is connected to the end of the tensioner.

13. The trimming device according to claim 1 wherein teeth are arranged on the tensioner in the longitudinal direction of the mast.

14. The trimming device according to claim 13 wherein a ratchet lever that is arranged on the mast in a pivoted fashion for engagement with the teeth, and wherein the adjusting element can be displaced relative to the mast by means of the ratchet lever.

15. The trimming device according to claim 13 wherein a locking lever arranged on the mast in a pivoted fashion for engagement with the teeth such that the tensioner is blocked from being displaced along the longitudinal axis in one direction.

16. The trimming device according to claim 1 wherein the tensioner can be actuated by means of a removable lever.

17. The trimming device according to claim 1 wherein at least one marking for ascertaining the trim of the sail is provided on the top of the sail.

18. A trimming device adapted for attachment to a mast of a windsurfing rig having a windsurfing sail, the trimming device comprising:

an adjusting element having a length which can be varied in order to adjust a bolt rope tension of the windsurfing sail, the adjusting element including a tensioner adapted for displacement along a longitudinal axis of the mast, locking elements for fixing the tensioner relative to the mast, a reducing element for increasing force applied to the mast, which element acts upon the tensioner along said longitudinal axis, and a connector for connecting the tensioner to the sail, the trimming device being attached to the mast top of the windsurfing rig, the tensioner having a threaded section engaging the mast for displacement of the tensioner relative to the mast.

19. A trimming device adapted for attachment to a mast of a windsurfing rig having a windsurfing sail, the trimming device comprising:

an adjusting element which can be displaced in order to adjust a bolt rope tension of the windsurfing sail, the adjusting element including a tensioner adapted for displacement in alignment with a longitudinal axis of the mast, locking elements for fixing the tensioner relative to the mast, a reducing element for increasing force applied to the mast, which element acts upon the tensioner along said longitudinal axis, a connector for connecting the tensioner to the sail, the trimming device being attached to the mast top of the windsurfing rig, and a block and pulley having a first pulley arranged on the free end of the mast and second pulleys arranged on the tensioner for displacing the tensioner relative to the mast.

20. A trimming device adapted for attachment to a mast of a windsurfing rig having a windsurfing sail, the trimming device comprising:

an adjusting element which can be displaced in order to adjust a bolt rope tension of the windsurfing sail, the adjusting element including a tensioner adapted for displacement along a longitudinal axis of the mast, the tensioner including a plurality of teeth arranged in a row extending along the longitudinal axis, locking elements for fixing the tensioner relative to the mast, a reducing element for increasing force applied to the mast, which element acts upon the tensioner along said longitudinal axis, a connector for connecting the tensioner to the sail, the trimming device being attached to the mast top of the windsurfing rig, and a ratchet lever pivotally mounted adjacent the tensioner for engaging the teeth, the ratchet being pivotable to displace the tensioner relative to the mast.

21. A trimming device adapted for attachment to a mast of a windsurfing rig having a windsurfing sail, the trimming device comprising:

an adjusting element which can be displaced in order to adjust a bolt rope tension of the windsurfing sail, the adjusting element including a tensioner adapted for displacement along a longitudinal axis of the mast, the tensioner including a plurality of teeth arranged in a row extending along the longitudinal axis, locking elements for fixing the tensioner relative to the mast, a reducing element for increasing force applied to the mast, which element acts upon the tensioner along said longitudinal axis, a connector for connecting the tensioner to the sail, the trimming device being attached to the mast top of the windsurfing rig, and a crank having a toothed wheel arranged to engage the teeth and rotatably mounted to displace the tensioner relative to the mast.

* * * * *